United States Patent [19]

Broberg, Jr.

[11] 4,421,145

[45] Dec. 20, 1983

[54] DEVICE FOR FORMING EYES AND LOOPS IN WIRE

[75] Inventor: Dewey O. Broberg, Jr., Long Grove, Ill.

[73] Assignee: Du-Bro Products, Inc., Wauconda, Ill.

[21] Appl. No.: 371,679

[22] Filed: Apr. 26, 1982

[51] Int. Cl.[3] ..... B21F 1/06

[52] U.S. Cl. ..... 140/104; 140/123

[58] Field of Search ..... 140/104, 123, 124, 115, 140/114, 119, 149

[56] References Cited

U.S. PATENT DOCUMENTS

| | | | |
|---|---|---|---|
| 2,006,355 | 7/1935 | Howell . | |
| 2,438,984 | 4/1948 | Adams . | |
| 2,657,718 | 11/1953 | Greathouse . | |
| 3,221,779 | 12/1965 | Noel . | |
| 3,297,060 | 1/1967 | Richardson | 140/123 |
| 3,578,035 | 5/1971 | Parker | 140/102.5 |
| 3,701,367 | 10/1972 | Ackerman | 140/119 |
| 3,990,486 | 11/1976 | Quick | 140/118 |

*Primary Examiner*—Francis S. Husar
*Assistant Examiner*—Linda McLaughlin
*Attorney, Agent, or Firm*—Hosier, Niro & Daleiden

[57] ABSTRACT

Two embodiments of devices are disclosed for forming eyelets and/or twists in wire. Both embodiments are self-contained tools and include relatively rotatable outer sleeves and inner cores for completely encapsulating and holding lengths of wire. In one embodiment, the wire can be formed with a closed loop and tight wraps about the length of wire inwardly of the closed loop while the length of wire is held by the device and the closed loop is rotated relative thereto. In the other embodiment, the wire can be formed with a closed loop, followed by helical twists, and then tightly wrapped inwardly of the helical twists as the closed loop is continuously rotated relative to the device while the length of wire is encapsulated and held thereby.

30 Claims, 27 Drawing Figures

FIG. 1
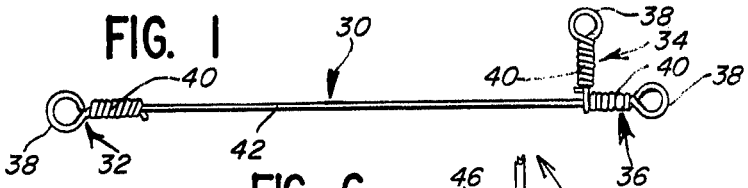
FIG. 6
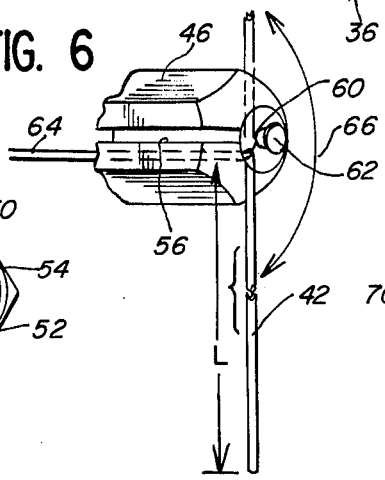
FIG. 7
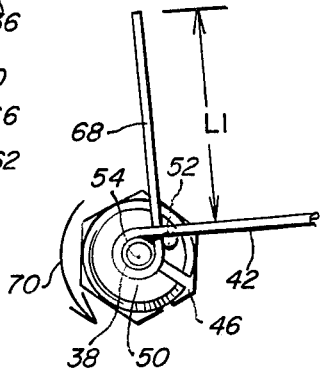
FIG. 2
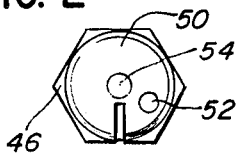
FIG. 2a
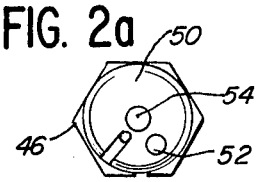
FIG. 3
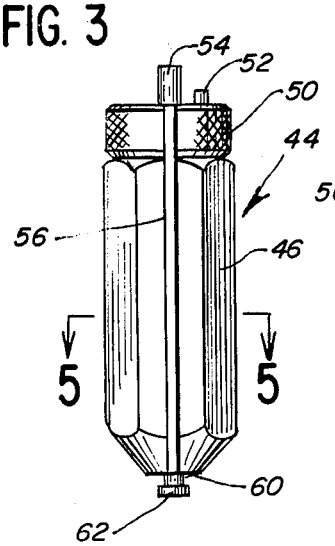
FIG. 3a
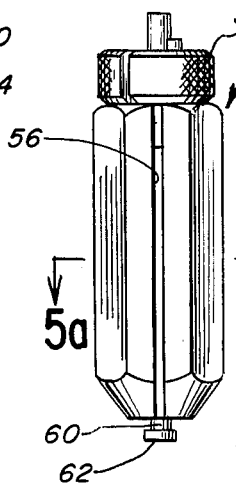
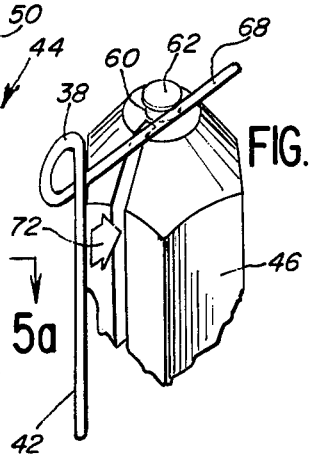
FIG. 8
FIG. 9
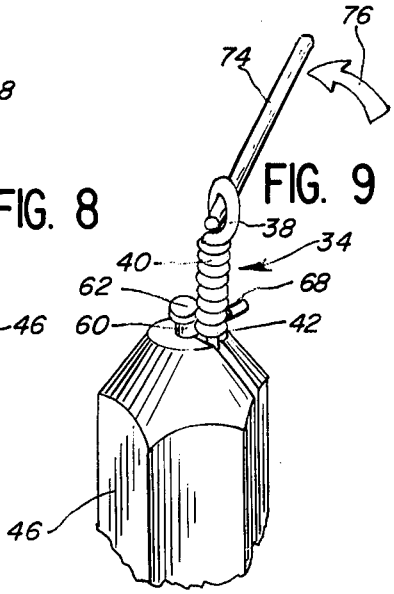
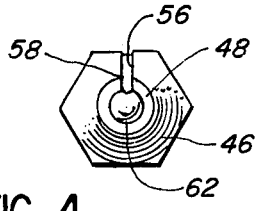
FIG. 4
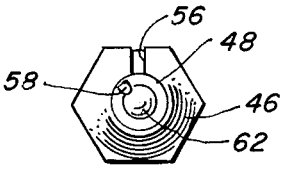
FIG. 4a
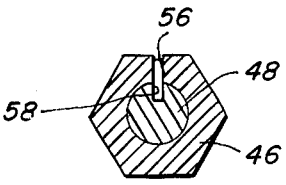
FIG. 5
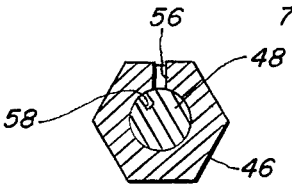
FIG. 5a
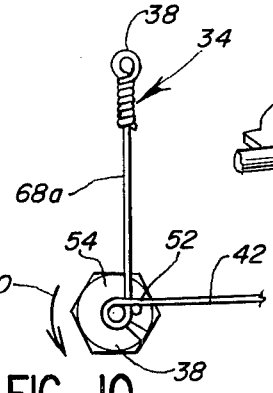
FIG. 10
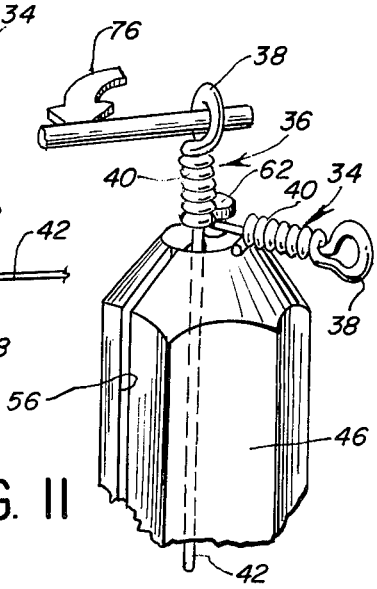
FIG. 11

FIG. 14
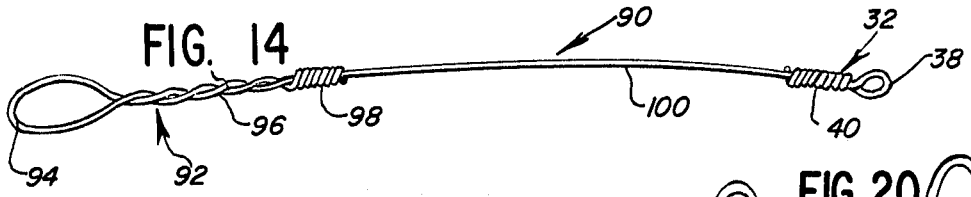
FIG. 15
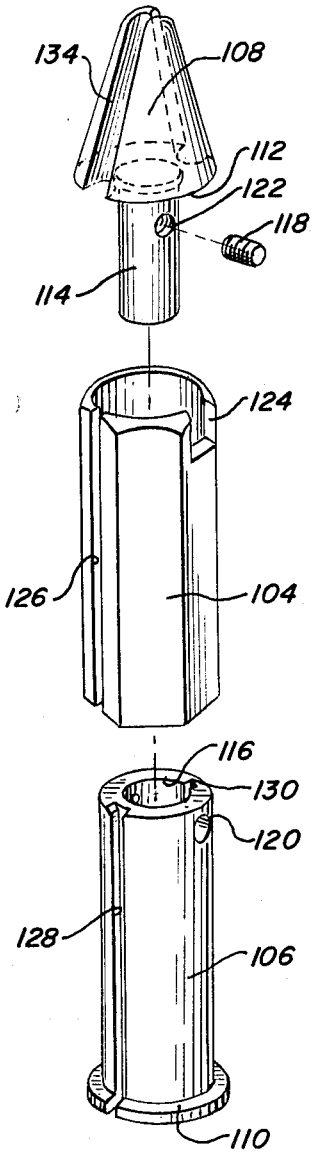
FIG. 16
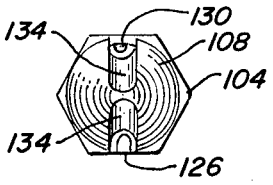
FIG. 17
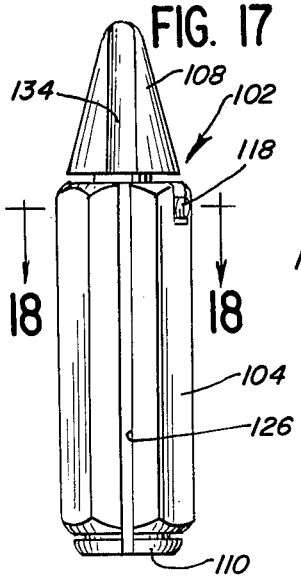
FIG. 18
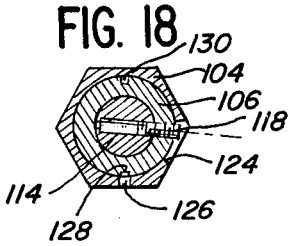
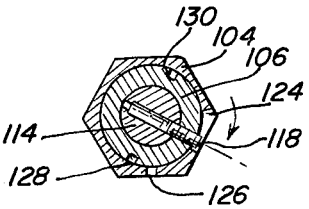
FIG. 18a
FIG. 19
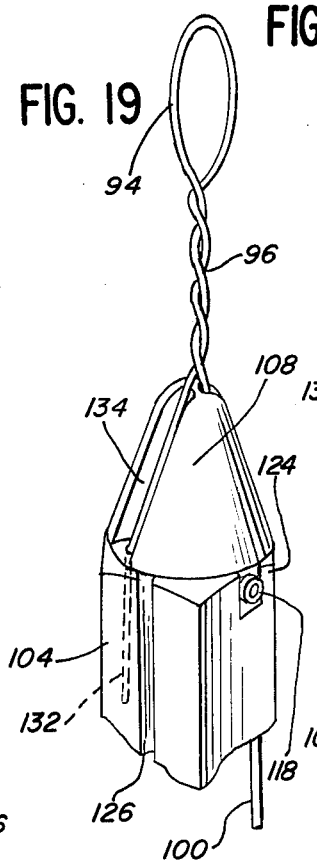
FIG. 20
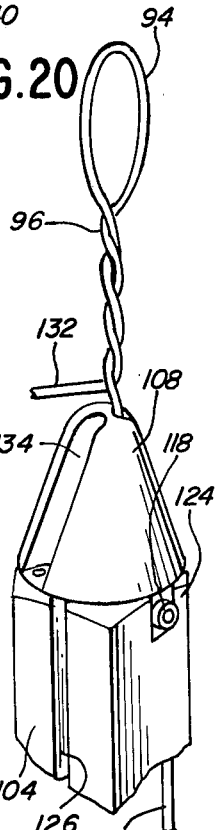
FIG. 21
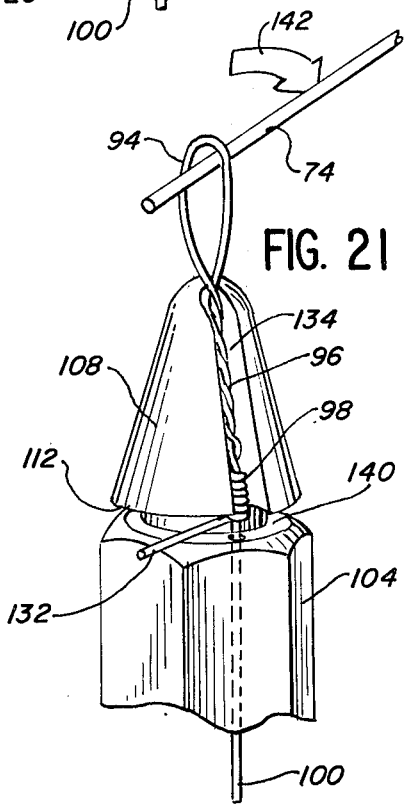

DEVICE FOR FORMING EYES AND LOOPS IN WIRE

BACKGROUND AND SUMMARY OF THE INVENTION

This invention relates generally to wire forming and twisting devices and, more particularly, to devices for forming loops or eyelets in wire. The invention is of particular interest to fishermen who wish to make their own wire leaders, lures or the like.

A fisherman often uses a wire extension at the end of a fishing line so that a fish, upon being caught, will be unable to break or cut the line and escape. The wire extension is called a leader. Attached to the leader may be a lure for attracting fish. Hooks also may be attached to the leader directly. There are commercially available an assortment of leaders and lures, but the preparation of leaders and lures is a highly individual matter for those to whom fishing is an art. Consequently, individuals often prefer to fabricate their own leaders and lures. A variety of devices are known for such purposes.

In fabricating leaders an important step is the formation of eyelets in the wire, normally at one or both ends of the leaders. The eyelets are formed by bending a length of wire into a loop and wrapping a free end portion of the wire about the length of wire in helical twists or coils to define the eyelet. In making a lure, versus a leader, a variety of devices attractive to fish are threaded onto a wire, and eyelets may be formed in the wire to retain the attractive devices on the wire. Eyelets are also useful in providing means whereby a hook may be directly attached to a line or leader. Other devices such as swivels, or the like, also are attached to wire lines or leaders by means of eyelets.

One of the problems with an individual fabricating his own wire leaders, lures, or the like, which include small eyelets, is in the difficulty of manually manipulating the wire during various bending operations. This is particularly true where the wire is of relatively stiff spring wire which is commonly used in ocean fishing. Tools heretofore provided for twisting, wrapping or tying eyelets in wire do not provide sufficient means for holding the wire while the various operations are performed thereon to form eyelets or the like. The wire tends to spring back to its original position and is extremely difficult to manipulate to form a neat, uniform and tightly wrapped construction. There is a definite need for a simple, hand tool to solve these problems.

An object, therefore, of the present invention is to provide a new and improved wire forming and twisting device and particularly to provide a device for forming loops and/or eyelets in wire.

The invention is disclosed herein in two different but somewhat similar embodiments. Both embodiments are designed for forming loops or eyelets in wire. Both embodiments include a novel elongated body construction which includes an outer sleeve and an inner core rotatable relative to each other but secured together as a self-contained unit to permit twisting or wrapping of the wire to hold and encapsulate a length of wire while the various twists or wraps are being performed therein. The outer sleeve and inner core have elongated grooves extending axially of the body. The grooves are alignable for positioning the length of wire into the groove in the inner core. The length of wire is completely encapsulated in the groove of the inner core by the outer sleeve in response to relative rotation thereof to misalign the grooves.

In one embodiment of the invention, means is provided at one end of the elongated two-part body for forming a closed loop in a length of wire held by the body, with a free end portion of the wire extending away from the closed loop. Means is provided on the opposite end of the two-part body for tightly wrapping the free end portion of the wire about the length of wire inwardly of the closed loop in response to relative rotation between the closed loop and the body while the length of wire is completely encapsulated between the outer sleeve and inner core of the body, to completely form an eyelet. After the eyelet is completely formed, the outer sleeve and inner core of the body can be rotated back to their original positions of alignment of their respective grooves and the length of wire, with the eyelet formed therein, can be removed from the body.

In particular, the means for forming the closed loop comprises a pair of spaced pins fixed to and protruding axially outwardly from the one end of the two-part body. One pin provides an abutment stop for the wire and the other pin provides a rounded surface about which the wire is bent to form the closed loop. A headed pin protrudes axially outwardly of the opposite end of the two-part body and about which the free end portion of the wire is rotated to tightly wrap the free end portion about the length of wire inwardly of the closed loop to completely form the eyelet. As disclosed herein, the pair of pins at one end of the body for forming the closed loop, and the headed pin at the opposite end of the body for forming the tight wraps, all are formed on and protrude axially outwardly of the inner core, with the outer sleeve encircling the inner core between the opposite ends thereof.

In the second embodiment of the invention, the two-part body has a tapered nose cone protruding axially from one end of the body. The nose cone has diametrically disposed axial slots on the exterior thereof for receiving portions of a length of wire after the wire is formed into a loop. The wire portions are encapsulated and held within cooperating elongated groove means between the outer sleeve and inner core of the body. The slotted nose cone provides means for twisting the wire helically away from the loop in response to relative rotation between the loop and the body. Second means, in the form of a peripheral groove about the body at the base of the nose cone, tightly wraps a free end portion of the wire about the length of wire inwardly of the innermost twist to completely form an eyelet including the twisted wire portion.

In both embodiments, stop limit means is provided operatively associated between the outer sleeve and inner core of the body to define the aligned positions of the elongated grooves in the sleeve and core, as well as to define a particular misaligned position of the grooves.

Other objects, features and advantages of the invention will be apparent from the following detailed description taken in connection with the accompanying drawings.

DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

FIG. 1 is an elevational view of a wire leader formed by one embodiment of the device or tool of the present invention;

FIG. 2 is a top plan view of the embodiment of the tool shown in FIG. 3;

FIG. 2*a* is a view similar to that of FIG. 2, with the outer sleeve and inner core relatively rotated;

FIG. 3 is a side elevational view of said one embodiment of the invention;

FIG. 3*a* is a view similar to that of FIG. 3, with the outer sleeve and inner core relatively rotated;

FIG. 4 is a bottom plan view of the tool of FIG. 3;

FIG. 4*a* is a bottom plan view of FIG. 3*a;*

FIG. 5 is a sectional view taken generally along line 5—5 of FIG. 3;

FIG. 5*a* is a sectional view taken generally along line 5*a*—5*a* of FIG. 3*a;*

FIG. 6 is a perspective view of one end of the tool being utilized to sever a length of wire from a supply thereof;

FIG. 7 is an end elevational view of the opposite end of the tool, with a length of wire being formed into a closed loop;

FIG. 8 is a perspective view of the end of the tool shown in FIG. 6, with the wire being inserted into the encapsulating grooves of the tool;

FIG. 9 is a perspective view similar to that of FIG. 8, with an implement being used to rotate the closed loop of the wire to form tight wraps to form a complete eyelet in the wire;

FIG. 10 is a top plan view similar to that of FIG. 7, on a reduced scale, illustrating the formation of a closed loop intermediate the ends of the length of wire;

FIG. 11 is a view similar to that of FIG. 9, on an enlarged scale, showing the formation of another eyelet in the length of wire;

FIG. 14 is a view of a wire leader with an eyelet formed on the right-hand end thereof by the tool of FIGS. 2–13, and with a twisted eyelet formed on the left-hand end thereof by the tool shown in FIGS. 2–21;

FIG. 15 is an exploded perspective view illustrating the components of a second embodiment of the invention;

FIG. 16 is a top plan view of the assembled tool of FIG. 15;

FIG. 17 is a side elevational view of the assembled tool of FIG. 15;

FIG. 18 is a sectional view taken generally along the line 18—18 of FIG. 17;

FIG. 18*a* is a sectional view similar to that of FIG. 18, with the outer sleeve and inner core relatively rotated;

FIG. 19 is a perspective view, on an enlarged scale, of the tool of FIG. 15, with a length of wire being encapsulated thereby and with twists being formed in the wire;

FIG. 20 is a view similar to that of FIG. 19, with a free end portion of the wire being bent outwardly of the twists after so formed; and FIG. 21 is a view similar to that of FIGS. 19 and 20, with the wire being formed with tight wraps adjacent the innermost twists in the wire.

DETAILED DESCRIPTION OF THE INVENTION

Figure 12:
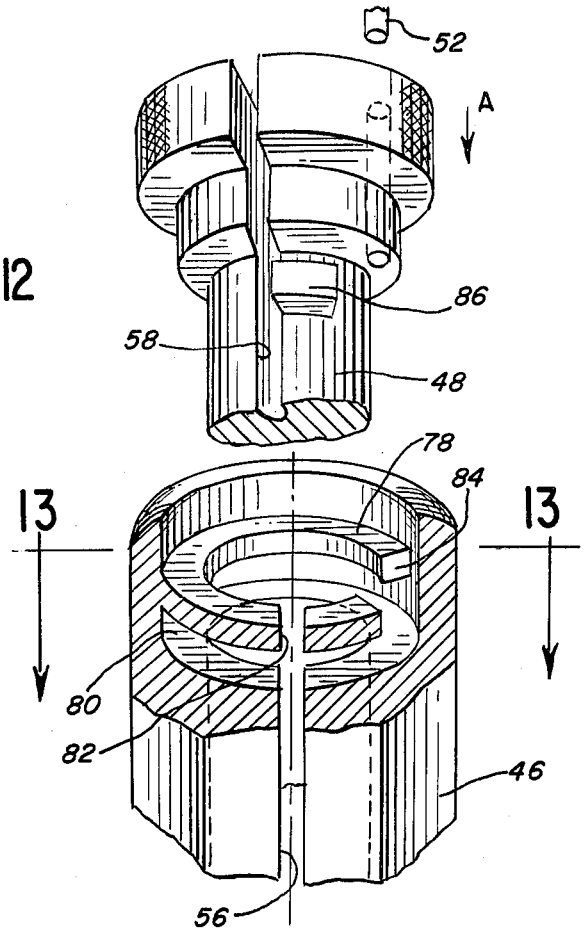
FIG. 12 is an exploded, fragmentary perspective view of adjacent ends of the outer sleeve and inner core of the tool shown in FIGS. 2–11.

Referring to the drawings in greater detail, it first should be noted that FIGS. 1–13*a* are directed to one embodiment of the invention, and FIGS. 14–21 are directed to a second embodiment of the invention. Both embodiments of the invention are somewhat similar as set forth hereinabove. However, the first embodiment of the invention shown in FIGS. 1–13*a* first will be described.

Referring to FIG. 1, a wire leader, generally designated 30, is shown as formed with eyelets generally designated 32, 34 and 36 by the device or tool shown in FIGS. 2–13*a*. Each eyelet 32–36 includes a closed loop 38 and a plurality of tight wraps 40 inwardly of each closed loop. The eyelets are disposed at opposite ends of a length of wire 42. As can be seen one eyelet 32 is formed on the left-hand end of the length of wire, and two eyelets 34, 36 are formed on the right-hand end of the length of wire.

The device or tool for forming eyelets 32–36 is shown assembled in FIGS. 2–5*a* and is generally designated 44. The tool includes a two-part body comprising an outer sleeve 46 and an inner core 48 rotatable relative to each other. Outer sleeve 46 has a hexagonal configuration to facilitate gripping and manual manipulation thereof, and inner core 48 has a knurled knob 50 exposed at one end of outer sleeve 46 also for gripping and manual manipulation purposes to facilitate relative rotation between the outer sleeve and inner core.

First means is provided on the two-part body of tool 44 for forming a closed loop in a length of wire with a free end portion of the wire extending away from the closed loop. More particularly, a pair of pins 52 and 54 are fixed to and protrude axially outwardly from one end of the tool. As will be described in greater detail hereinafter, one pin 52 provides an abutment stop for the wire, and the other pin 54 provides a rounded surface about which the wire is bent to form a closed loop.

After the closed loop is formed, second means is provided on the tool for completely encapsulating and holding the length of wire. More particularly, as described in greater detail hereinafter, elongated grooves 56 and 58 are formed in the outer sleeve 46 and inner core 48, respectively. The grooves are alignable as shown in FIGS. 2–5 for positioning a length of wire into groove 58 in inner core 48. The length of wire then can be completely encapsulated in groove 58 by outer sleeve 46 in response to relative rotation of the outer sleeve and inner core to misalign grooves 56 and 58 as shown in FIGS. 2*a*–5*a*.

Third means is provided on tool 44 for tightly wrapping a free end portion of the wire about the length of wire inwardly of the closed loop to completely form an eyelet. More particularly, as described in greater detail hereinafter, a pin 60, having a head 62, protrudes axially outwardly of the tool at the end thereof opposite pins 52, 54. Headed pin 60 is formed integral with and protudes outwardly from inner core 48.

Referring to FIGS. 6–11, the operation of tool 44 in order to form eyelets 32–36 (FIG. 1) on the ends of length of wire 42 to form leader 30 will now be described. Referring first to FIG. 6, length "L" of wire 42 first is severed from a supply 64 of wire, such as from a coil thereof. This is done by inserting wire supply 64 into grooves 56, 58 in outer sleeve 46 and inner core 48 when the grooves are aligned as shown in FIGS. 2–5. The outer sleeve and inner core then are relatively rotated to completely encapsulate the wire as shown in FIG. 6. Length of wire 42 then is bent back and forth in the direction of double-headed arrow 66 until the length of wire is severed from supply 64 thereof.

The next step in forming an eyelet 32–36 is shown in FIG. 7. The length of wire is positioned between pins 52, 54 so that a free end portion 68 of the wire protrudes transversely outwardly of the tool. The length of wire then is bent around pin 54 to form a closed loop 38, as pin 52 acts as an abutment stop for free end portion 68 of the wire. The wire is bent into a closed loop until the free end portion and the remaining length of wire are disposed generally at a right-angle as shown in FIG. 7. This can be done simply by holding the length of wire and rotating the tool in the direction of arrow 70. It should be noted that the length "L1" of the free end portion 68 of the wire can be determined so as to be capable of forming a sufficient number of tight wraps 40 as described hereinafter.

Referring to FIG. 8, outer sleeve 46 and inner core 48 are relatively rotated to realign grooves 56, 58. The length of wire 42, with closed loop 38 having been formed therein, then is inserted into the aligned grooves in the direction of arrow 72, with the free end portion 68 of the wire disposed beneath head 62 of pin 60.

Referring to FIG. 9, outer sleeve 46 and inner core 48 then are relatively rotated (to the position shown in FIGS. *2a–5a*) to encapsulate the length 42 of wire within groove 58 of the inner core. With the free end portion 68 of the wire abutting against pin 60 and seated beneath head 62, closed loop 38 then is rotated relative to the tool to form tight wraps 40 about the length of wire 42 inwardly of the closed loop. This can be accomplished simply by inserting a rod-like object, such as a simple nail 74 or the like, into closed loop 38 and rotating the same in the direction of arrow 76.

At this point, it should be noted that the eyelet shown in FIG. 9 could be either eyelet 32 or eyelet 34 as shown at either end of leader 30 in FIG. 1. However, to facilitate the illustration of two eyelets 34, 36 at a single end of the leader, FIGS. 9 and 10 show the eyelet as eyelet 34. Referring to FIG. 10, in order to form second eyelet 36 at the same end of the leader, the length of wire 42 is again positioned onto the tool as described in relation to FIG. 7. The only difference is that eyelet 34 is disposed at a free end 68*a* of the length of wire. Subsequent steps are identical to that described above and are performed until eyelet 36 is formed as shown in FIG. 11. Again, the only difference is that previously formed eyelet 34 already has been formed on the free end of the wire.

Figure 13:
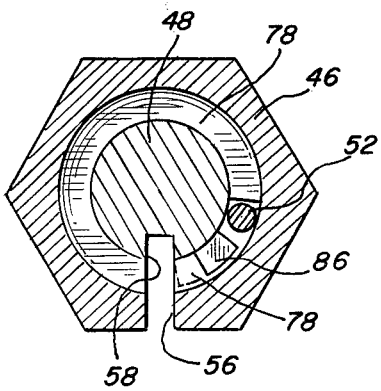
FIG. 13 is a sectional view taken generally along line 13—13 of FIG. 12.
Figure 13A:
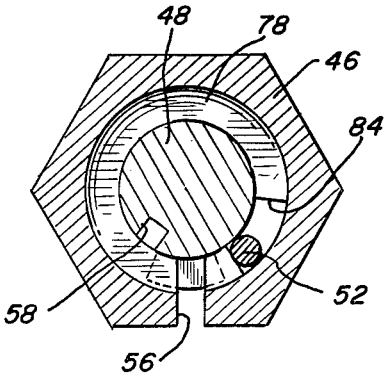
FIG. 13*a* is a sectional view similar to that of FIG. 13, with the outer sleeve and inner core relatively rotated.

Referring to FIGS. 12–13*a*, stop limit means is operatively associated between outer sleeve 46 and inner core 48 to define the aligned positions of elongated grooves 56 and 58 in the outer sleeve and inner core respectively. In addition, means is operatively associated between the outer sleeve and inner core for securing the sleeve and core together as a self-contained unit while affording relative rotation therebetween. More particularly, an annular ring 78 is formed integrally on the inside of sleeve 46 to define an annular groove 80 therebeneath. Ring 78 is interrupted at 82 to form a continuation of groove 56 in the outer sleeve. In addition, ring 78 is interrupted at 84. Interruption 84 performs two purposes. First, it receives a lug 86 protruding outwardly from inner core 48 when the core is assembled to the sleeve in the direction of arrow "A" (FIG. 12). Lug 84 is sized to rotatably slide within annular groove 80 beneath ring 78. This will lock or secure the sleeve and core together in an axial direction as a self-contained unit while affording relative rotation therebetween. Secondly, interruption 84 receives the lower end of pin 52 therebetween to define the limits of relative rotation between the outer sleeve and inner core.

More particularly, FIG. 13 shows outer sleeve 46 and inner core 48 in the position shown in FIGS. 2–5, with groove 56 in the sleeve and groove 58 in the core in alignment. It can be seen that lug 86 of the core is disposed beneath a portion of annual ring 78 to axially lock the core and sleeve together. The lower end of pin 52 is disposed in the gap in annular ring 78 defined by interruption 84. FIG. 13*a* shows outer sleeve 46 and innner core 48 relatively rotated to the position shown in FIGS. *2a–5a*. In this position, groove 58 in the inner core now is misaligned with groove 56 in the outer sleeve to provide a position to encapsulate and hold a length of wire. It can be seen that the lower end of pin 52 now has abutted the opposite side of interruption 84 in ring 78 to now define said misaligned position of the grooves 56, 58.

Referring to FIGS. 14–21, the second embodiment of the invention now will be described. FIG. 14 shows a wire leader, generally designated 90, having an eyelet 32 formed on the right-hand thereof, with closed loop 38 and tight wraps 40, formed by the embodiment of the tool shown in FIGS. 2–13*a*. The left-hand end of leader 90 has an eyelet, generally designated 92, formed by the embodiment of the invention shown in FIGS. 15–21. Eyelet 92 includes a closed loop 94, helical twists 96 inwardly of the closed loop, and tight wraps 98 similar to wraps 40. Eyelets 32 and 92 are formed on opposite ends of a length of wire 100.

Referring to FIGS. 15–18*a*, the second embodiment of the tool is generally designated 102 and includes a two-part body comprising an outer sleeve 104 and an inner core which itself is of two-parts including an elongated core part 106 and a nose cone 108.

As with tool 44 (FIGS. 2–13*a*), tool 102 has means operatively associated between the outer sleeve and the inner core for securing the sleeve and core together as a self-contained unit while affording relative rotation between the core and sleeve. More particularly, core part 106 has a lower peripheral flange 110 protruding radially outwardly thereof. Nose cone 108 has a lower shoulder 112 and a depending shaft portion 114 of reduced diameter. Shaft portion 114 is positionable within a cylindrical bore 116 in the top of core part 106. The tool is assembled by positioning outer sleeve 104 over core part 106 until the lower end of the sleeve abuts against flange 110. Nose cone 108 then is positioned on top of the sleeve, with shaft portion 114 inserted into cylindrical bore 116. A set screw 118 then is inserted through a hole 120 in core part 106 and threaded into a threaded hole 122 in shaft portion 14 of nose cone 108. Thus, core part 106 and nose cone 108 and secured together for conjoint rotation, while outer sleeve 104 is sandwiched between flange 110 and shoulder 112 for rotation relative to the two-part inner core.

Stop limit means also is provided to define the limits of relative rotation between outer sleeve 104 and inner core portion 106 (nose cone 108) as with tool 44. More particularly, set screw 118 protrudes outwardly of shaft 114 and extends into a cut-out portion 124 at the top of sleeve 104. The sides of cut-out portion 124 define abutment surfaces for set screw 118 and thereby define the aligned and misaligned positions of an elongated groove 126 in the outer sleeve and a complementary elongated groove 128 in core part 106. FIG. 18 shows the components with the grooves in alignment, and FIG. 18*a* shows the grooves out of alignment for encapsulating and holding a length of wire.

Tool 102 includes first means for forming loop 94 in the length of wire 100 and twisting the wire helically away from the loop, to form twists 96, in response to relative rotation between the loop and the tool. More particularly, in addition to alignable grooves 126 and 128 in the outer sleeve and inner core, respectively, core part 106 has a second elongated, axial groove 130 on the exterior thereof and which is constantly closed by outer sleeve 104 as best shown in FIGS. 16, 18 and 18*a*. Referring to FIG. 19, length of wire 100 is inserted longitudinally through closed groove 130 from the end of the tool opposite nose cone 108. The wire then is bent into a loop and the free end of the wire is inserted into aligned grooves 126, 128. The outer sleeve and inner core then are relatively rotated to lock the free end of the wire in a held, encapsulated condition as shown in dotted lines 132 in FIG. 19. Nose cone 108 is provided with a pair of diametrically disposed axial slots on the tapered exterior of the nose cone. These slots will engage and capture the portions of the wire as the tool is rotated relative to loop 94.

More particularly, with the length of wire 100 and the free end portion 132 of the wire being encapsulated and held between the outer sleeve and inner core of the tool, relative rotation between loop 94 and the tool can be effected. Upon this relative rotation, the wire portions extending away from the loop will seat within slots 134 of the nose cone. Further relative rotation between the loop and the tool will cause the wire to form twists as the slots bias the wire portions into a helical twisted configuration.

After a sufficient number of twists 96 have been formed in the wire inwardly of closed loop 94, the wire is pulled axially of the tool (upwardly as viewed in FIG. 20) to release the free end portion of the wire. Of course, the free end portion can be released by simply relatively rotating the outer sleeve and inner core to align grooves 126, 128 whereby the free end portion of the wire will snap out of the aligned grooves. The free end portion of the wire then is bent at a right angle to the series of twists 96, as shown in FIG. 20. Due to the relatively stiff nature of the wire, the twists will remain intact.

The twisted wire then is rotated about its axis until the free end portion 132 of the wire protrudes radially outwardly of the tool, directly out from the slot 134 (FIG. 21) which receives the length of wire 100.

Referring to FIG. 21, the free end portion 132 of the wire then is disposed within a peripheral groove 140 defined between the top of outer sleeve 104 and the lower shoulder 112 of nose cone 108. A rod-like member, such as common nail 74, then is inserted into closed loop 94 and the previously twisted wire is rotated in the direction of arrow 142. This further rotation of the twisted wire causes the free end portion 132 of the wire to tightly wrap about the length of wire 100 until wraps 98 are formed to complete the twisted, wrapped eyelet 92 as shown in FIG. 14. This wrapping action does not disturb the previously formed twists 96. In order to insure that peripheral groove 140 is maintained to accommodate the free end portion 132 of the wire, it can be seen in FIGS. 17, 19 and 20 that set screw 118 seats against the bottom of cutout 124 in outer sleeve 104.

Thus, it can be seen that two embodiments of a device have been provided by the present invention for forming eyelets in a length of wire. One tool 44 (FIGS. 2–13*a*) forms eyelets 32–36 with a closed loop 38 and tight wraps 40. Tool 102 (FIGS. 15–21) forms eyelets 92 with a closed loop 94, twists 96 and tight wraps 98. Both tools are self-contained units with relatively rotatable outer sleeves and inner cores secured together while affording relative rotation therebetween, to hold and encapsulate lengths of wire and thereby eliminate much of the problems involved in manually manipulating the wire, particularly relatively stiff spring wire, as has been a continuing problem with the prior art. The tools are extremely simple to operate and, in fact, eyelets 32–36 and 92 can be formed from a length of wire in a matter of seconds once an individual is familiar with the tool. The tools are extremely durable and can be fabricated of such material as brass to practically eliminate any wear from engagement and manipulation of wire. The tools can be sized to be finger manipulated and carried around in a small fishing tackle box or even in a fisherman's pocket.

It will be understood that the invention may be embodied in other specific forms without departing from the spirit or central characteristics thereof. The present examples and embodiments, therefore, are to be considered in all respects as illustrative, and the invention is not to be limited to the details given herein.

What is claimed is:

1. A device for forming an eyelet in wire, comprising:
a body;
a first means on said body for forming a closed loop in a length of wire with a free end portion of the wire extending transversely away from a straight portion of the wire;
second means on said body for completely encapsulating and holding said straight portion of the wire; and
third means on said body for tightly wrapping said free end portion of the wire about the straight portion of the wire inwardly of said closed loop in response to relative rotation between the closed loop and the body while the straight portion of the wire is completely encapsulated by said second means, to completely form said eyelet.

2. The device of claim 1 wherein said first means comprises a pair of spaced pins fixed to and protruding outwardly of said body, one pin providing an abutment stop for the wire and the other pin providing a rounded surface about which the wire is bent to form said closed loop.

3. The device of claim 2 wherein said body is elongated and said pair of pins protrudes axially outwardly from one end of the body, said third means being disposed on the opposite end of the body.

4. The device of claim 3 wherein said third means comprises a headed pin protruding axially outwardly of said opposite end of the body, and said second means encapsulates the length of wire axially on the body.

5. The device of claim 1 wherein said third means comprises a peripheral groove about said body, and said second means encapsulates the straight portion of the wire transversely of said groove.

6. The device of claim 1 wherein said body includes two parts, an outer sleeve and an inner core rotatable relative to each other, and said second means comprises an elongated groove in each of said outer sleeve and inner core, said grooves being alignable for positioning the straight portion of the wire into the groove in the inner core, and the straight portion of the wire being completely encapsulated in the groove of the inner core by the outer sleeve in response to relative rotation thereof to misalign said grooves.

7. The device of claim 6 wherein said body is elongated and said grooves extend axially along one side thereof.

8. The device of claim 7 wherein said first means is disposed at one end of said body and said third means is disposed at the opposite end of said body.

9. The device of claim 8 wherein said first means comprises a pair of spaced pins fixed to and protruding axially outwardly of said one end of said body, one pin providing an abutment stop for the wire and the other pin providing a rounded surface about which the wire is bent to form said closed loop.

10. The device of claim 9 wherein said third means comprises a headed pin protruding axially outwardly of said opposite end of said body.

11. The device of claim 6 wherein said third means comprises a peripheral groove about said body adjacent one end of said elongated grooves in said outer sleeve and said inner core.

12. The device of claim 6 including stop limit means operatively associated between said outer sleeve and inner core to define said aligned position of said elongated grooves.

13. The device of claim 12 wherein said stop limit means includes means to define a particular misaligned position of said elongated grooves.

14. The device of claim 7 including means operatively associated between said outer sleeve and said inner core for securing the sleeve and core together as a self-contained unit while affording said relative rotation therebetween.

15. A device for forming an eyelet in wire, comprising:

a body including two parts, an outer sleeve and an inner core rotatable relative to each other, elongated groove means axially along one side of said body and including an elongated groove in each of said outer sleeve and inner core, said grooves being alignable for positioning a length of wire into the groove in the inner core, and the length of wire being completely encapsulated in the groove of the inner core by the outer sleeve in response to relative rotation thereof to misalign said grooves; and means on said body exteriorly of said outer sleeve for forming an eyelet at one end of said length of wire while the length of wire is completely encapsulated by said body.

16. The device of claim 15 including stop limit means operatively associated between said outer sleeve and inner core to define said aligned position of said elongated grooves.

17. The device of claim 16 wherein said stop limit means includes means to define a particular misaligned position of said elongated grooves.

18. The device of claim 15 wherein the outer periphery of said outer sleeve is polygonal in cross-section to facilitate gripping and rotating the sleeve relative to said inner core.

19. The device of claim 18 wherein said inner core protrudes from at least one end of said outer sleeve providing means for gripping and facilitating relative rotation of said outer sleeve and said inner core.

20. A device for forming an eyelet in wire, comprising:

a body;

first means on said body for forming a loop in a length of wire and twisting the wire helically away from the loop in response to relative rotation between the loop and the body; and second means on said body for tightly wrapping a free end portion of the wire about a straight portion of the wire inwardly of the innermost twist to completely form said eyelet.

21. The device of claim 20 wherein said first means comprises a tapered nose cone on said body, said nose cone having opposed axial slots on the exterior thereof for receiving portions of said length of wire extending away from said loop, said slots biasing said wire portions to form helical twists in the wire away from the loop in response to relative rotation between the loop and the body.

22. The device of claim 21 wherein said second means comprises a peripheral groove about said body at the base of said nose cone for receiving said free end portion of the wire after said helical twists are formed.

23. The device of claim 21 including means on said body for holding said wire portions in said slots of said nose cone.

24. The device of claim 23 wherein said means for holding said wire portions includes means for completely encapsulating the wire portions.

25. The device of claim 24 wherein said means for holding and encapsulating said wire portions comprise a pair of generally parallel bores through said body, ends of the bores being in alignment with said slots at the base of said nose cone.

26. The device of claim 21 wherein said body is elongated and includes two parts, an outer sleeve and an inner core, said inner core having said tapered nose cone on one end thereof exposed at one end of said outer sleeve, and said outer sleeve and said inner core having cooperating means for holding said wire portions in said slots in said nose cone.

27. The device of claim 26 wherein said inner core has a pair of elongated grooves extending axially thereof along the outer periphery thereof and in alignment with said slots at the base of said nose cone for receiving said wire portions, said outer sleeve completely covering one of said elongated grooves and including a complementary elongated groove alignable with the other elongated groove in said inner core for positioning one of said wire portions into the groove in the inner core, the wire portion being completely encapsulated in the groove of the inner core by the outer sleeve in response to relative rotation thereof to misalign the grooves.

28. The device of claim 27 including stop limit means operatively associated between said outer sleeve and inner core to define said aligned position of said elongated grooves.

29. The device of claim 28 wherein said stop limit means includes means to define a particular misaligned position of said elongated grooves.

30. The device of claim 27 including means operatively associated between said outer sleeve and said inner core for securing the sleeve and core together as a self-contained unit while affording said relative rotation therebetween.

* * * * *